US006899930B2

(12) United States Patent
Kiyama et al.

(10) Patent No.: US 6,899,930 B2
(45) Date of Patent: May 31, 2005

(54) RECORDING MATERIAL FOR INK-JET

(75) Inventors: Hideto Kiyama, Tokyo (JP); Yukio Tokunaga, Tokyo (JP); Hanae Nakatani, Tokyo (JP); Norimasa Miyachi, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 20 days.

(21) Appl. No.: 10/221,569

(22) PCT Filed: Sep. 28, 2001

(86) PCT No.: PCT/JP01/08517

§ 371 (c)(1),
(2), (4) Date: Sep. 13, 2002

(87) PCT Pub. No.: WO02/34541

PCT Pub. Date: May 2, 2002

(65) Prior Publication Data

US 2003/0072925 A1 Apr. 17, 2003

(30) Foreign Application Priority Data

| | | |
|---|---|---|
| Oct. 24, 2000 | (JP) | 2000-324026 |
| Dec. 21, 2000 | (JP) | 2000-388225 |
| Mar. 23, 2001 | (JP) | 2001-085985 |

(51) Int. Cl.[7] ..... B41M 5/40
(52) U.S. Cl. ..... 428/32.25; 428/32.35
(58) Field of Search ..... 428/32.25, 32.35

(56) References Cited

U.S. PATENT DOCUMENTS

| | | | | | |
|---|---|---|---|---|---|
| 5,750,200 | A | * | 5/1998 | Ogawa et al. | 427/361 |
| 6,183,851 | B1 | * | 2/2001 | Mishima | 428/32.34 |
| 6,242,082 | B1 | * | 6/2001 | Mukoyoshi et al. | 428/32.18 |
| 6,387,473 | B1 | * | 5/2002 | Sismondi et al. | 428/32.34 |
| 6,465,086 | B1 | * | 10/2002 | Kitamura et al. | 428/32.25 |
| 2001/0004487 | A1 | * | 6/2001 | Kaneko et al. | 428/195 |

FOREIGN PATENT DOCUMENTS

| | | |
|---|---|---|
| EP | 943450 | 9/1999 |
| JP | 10-119424 | 5/1998 |
| JP | 11-48603 | 2/1999 |
| JP | 11-192777 | 7/1999 |
| JP | 11-301108 | 11/1999 |
| JP | 2000-37944 | 2/2000 |
| JP | 2000-62314 | 2/2000 |
| JP | 2000-263924 | 9/2000 |
| JP | 2000-280603 | 10/2000 |

* cited by examiner

*Primary Examiner*—B. Shewareged
(74) *Attorney, Agent, or Firm*—Paul E. White, Jr.; Manelli Denison & Selter PLLC

(57) ABSTRACT

According to the present invention, in an ink-jet recording material in which at least two ink-receptive layers containing inorganic fine particles and a hydrophilic binder are provided on a support, an ink-jet recording material wherein an ink-receptive layer (A) nearer to the support contains fumed silica, and an ink-receptive layer (B) apart from the support contains alumina or alumina hydrate is provided.

17 Claims, No Drawings

RECORDING MATERIAL FOR INK-JET

This application is the national phase of international application PCT/JP01/08517 filed 28 Sep. 2001 which designated the U.S.

TECHNICAL FIELD

The present invention relates to an ink-jet recording material, particularly to an ink-jet recording material which has high glossiness and high ink-absorption property, high printing density, excellent in coloring property, and excellent in surface strength.

BACKGROUND ART

As a recording material to be used for an ink-jet recording system, there has been known a recording material which comprises a usual paper or a support called to as an ink-jet recording sheet on which a porous ink-absorption layer comprising a pigment such as amorphous silica and a hydrophilic binder such as polyvinyl alcohol and the like.

As a recording material to be used for an ink-jet recording system, there has generally been known a recording material which comprises a swelling type ink-receptive layer comprising a binder that is swelled by a solvent such as water, etc. or a porous ink-receptive layer comprising a pigment such as amorphous silica, etc. and a water-soluble binder such as polyvinyl alcohol, etc., being provided on a support such as a usual paper or the so-called ink-jet recording sheet. In terms of ink-absorption property, the one with a porous ink-receptive layer is more preferred.

There have been proposed recording materials obtained by coating a silicon-containing pigment such as silica, etc., with an aqueous binder onto a paper support as disclosed in, for example, Japanese Provisional Patent Publications No. 51583/1980, No. 157/1981, No. 107879/1982, No. 107880/1982, No. 230787/1984, No. 160277/1987, No. 184879/1987, No. 183382/1987, No. 11877/1989, and the like.

Also, in Japanese Patent Publication No. 56552/1991, Japanese Provisional Patent Publications No. 188287/1990, No. 132728/1996, No. 81064/1998, No. 119423/1998, No. 175365/1998, No. 203006/1998, No. 217601/1998, No. 20300/1999, No. 20306/1999 and No. 34481/1999, there have been disclosed ink-jet recording materials using synthetic silica fine particles prepared by a gas phase process (hereinafter referred to as "fumed silica"). However, it was difficult to improve both of ink-absorption property and glossiness.

Also, in Japanese Provisional Patent Publications No. 174183/1987, No. 276670/1990, No. 32037/1993, No. 199034/1994, and the like, there have been disclosed recording materials which use alumina or alumina hydrate. However, they are good in glossiness but ink-absorption property was insufficient.

Also, in Japanese Provisional Patent Publication No. 86509/1998, there is disclosed an ink-jet recording material which uses an amorphous silica or alumina silicate having a primary particle size of 3 to 40 nm and an average particle size of secondary aggregated particles of 10 to 200 nm, and a Haze degree of the ink-receptive layer is 4 to 65%.

However, when ink-absorption property is improved by using amorphous silica or alumina silicate having an average primary particle diameter of 3 to 40 nm alone, then, printing density or coloring property is lowered so that it was impossible to satisfy both of the above.

Also, it has been proposed to provide a glossiness developing layer as an upper layer in Japanese Provisional Patent Publications No. 215080/1991, No. 89220/1995, No. 117335/1995, No. 37944/2000 and the like.

In Japanese Provisional Patent Publication No. 55829/1994, there has been disclosed a recording sheet having been provided a silica porous layer as a lower layer, and a layer containing alumina or alumina hydrate as an upper layer, and also, in Japanese Provisional Patent Publication No. 89216/1995, there has been proposed a recording material in which a layer containing a water-absorption pigment is provided as a lower layer and a layer into which pseudo boehmite is provided at the outermost layer. However, the pigments to be used in these lower layers are coarse since their average particle sizes are several $\mu$m or more, so that sufficient glossiness cannot be obtained. Also, to attain sufficient glossiness, it is necessary to make a coating amount of alumina or alumina hydrate in an upper layer large, and as a result, ink-absorption property is lowered. Thus, it cannot be satisfied sufficiently both of the glossiness and ink-absorption property.

In the prior art, an aqueous dye has been exclusively used as a coloring material to be used for ink for ink-jet recording, but the aqueous dye has a defect that it is inferior in light resistance or water resistance, so that a pigment ink excellent in light resistance, water resistance has been used in recent years. However, in the pigment ink, it is necessary to disperse water-insoluble pigment particles and to maintain the same stably. Also, pigment ink has problems that it is likely lowered in drying property of ink after printing and scuffing resistance as compared with aqueous dyes. Moreover, as compared with the aqueous dyes, the pigment ink is generally inferior in ink-absorption property.

On the other hand, in the above-mentioned ink-jet recording material having a void structure using ultrafine particles such as fumed silica, alumina and alumina hydrate, it has high surface smoothness and high glossiness can be obtained. But on the other hand, the surface strength thereof is relatively weak, and it has a defect that scuffmark due to contact with rollers at the time of production or processing, or damage on the surface thereof when a plural number of sheets are overlapped and printing is carried out by feeding these sheets is likely caused.

An object of the present invention is to provide an ink-jet recording material having high glossiness, ink-absorption property and printing density, excellent in coloring property, and has good surface strength. Another object of the present invention is to provide an ink-jet recording material, in particular, even when a pigment ink is used,-that has a sufficient ink-absorption property, no unevenness in glossiness at the printed portion and excellent in scuffing resistance.

SUMMARY OF THE INVENTION

The above objects of the present invention can be basically accomplished by an ink-jet recording material comprising a support and at least two ink-receptive layers containing inorganic fine particles and a hydrophilic binder provided thereon, wherein an ink-receptive layer (A) nearer to the support contains fumed silica, and an ink-receptive layer (B) apart from the support contains alumina or alumina hydrate.

BEST MODE FOR CARRYING OUT THE INVENTION

In the following, the present invention is explained in detail.

As the support to be used in the present invention, there may be used plastic resin films such as polyethylene, polypropylene, polyvinyl chloride, diacetate resin, triacetate resin, cellophane, acrylic resin, polyethylene terephthalate, polyethylene naphthalate, etc., water resistance supports such as a resin-coated paper in which a polyolefin resin is laminated on the both surfaces of paper, or water-absorptive supports such as fine quality paper, art paper, coated paper, cast coated paper and the like. A water resistance support is preferably used. A thickness of these supports to be used is preferably in the range of about 50 to 250 μm or so.

In the ink-receptive layer A of the present invention, fumed silica is contained. In synthetic silica, there are two types of materials, one of which is prepared by the wet process and the other is prepared by the gas phase process. As the silica fine particles, it generally means the wet process silica in many cases. As the silica prepared by the wet process, there are (1) a silica sol obtained by metathesis of sodium silicate by an acid or passing through an ion exchange resin layer; (2) a colloidal silica obtained by heating and maturing the silica sol; (3) a silica gel obtained by gelling silica sol in which formation conditions thereof are changed whereby primary particles of a silica gel are agglomerated to form three-dimensional secondary particles having a diameter of several μm to 10 μm; and (4) a synthetic silicic acid compound mainly comprising silicic acid obtained by heating silica sol, sodium silicate, sodium aluminate, etc.

Fumed silica to be used in the present invention is also called to as the drying method silica, and it can be generally prepared by a flame hydrolysis method. More specifically, it has been generally known a method in which silicon tetrachloride is burned with hydrogen and oxygen, and silanes such as methyltrichlorosilane and trichlorosilane may be used alone in place of the silicon tetrachloride or in admixture with the silicon tetrachloride. The fumed silica is commercially available from Nippon Aerosil K.K. under the trade name of Aerosil, and K.K. Tokuyama under the trade name of QS type, etc. In general, the fumed silica is present in the form of secondary particles having suitable voids by aggregation, so that it is preferably used by pulverizing or dispersing with ultrasonic wave, a high-pressure homogenizer or a counter collision type jet pulverizer until it becomes secondary particles of about 50 to 300 nm since the resulting material gives good ink-absorption property and glossiness.

Alumina and alumina hydrate contained in the ink-receptive layer B of the present invention are aluminum oxide or a hydrate thereof, which may be crystalline or non-crystalline, and those having a shape of amorphous, spherical, tabular and the like may be used. Either of them may be used or both of them maybe used in combination. In particular, tabular alumina hydrate having an aspect ratio of 2 or more and an average primary particle size of 5 to 30 nm is preferred. The aspect ratio of the primary particle of alumina hydrate can be obtained as a ratio of an average particle size relative to an average thickness.

In the present invention, in a system in which a tabular alumina hydrate having an aspect ratio of 2 or more is contained in the ink-receptive layer B, it is preferred that spindle shaped or spherical shaped fine particles having an average particle size of 3 μm or less are used in combination in the ink-receptive layer B. A preferred average particle size of the above-mentioned spindle shaped or spherical shaped fine particles is 1 μm or less, and a lower limit is about 0.1 μm. In this case, a thickness of the ink-receptive layer B is preferably set to 1 μm or more. By employing such a constitution, an ink-jet recording material having good surface scuffing resistance and high glossiness can be obtained. In particular, by formulating the spindle shaped or spherical shaped fine particles having an average particle size of 3 μm or less in an amount of 0.5 to 15% by weight, preferably 1 to 10% by weight based on the tabular alumina hydrate, lowering in glossiness can be restrained, and scuffing resistance and feeding and conveying property become good. By making a ratio of the average particle size of the spindle shaped or spherical shaped particles relative to the average thickness of the tabular alumina hydrate 1/1 or more, more preferably 2/1 to 80/1, the spindle shaped or spherical shaped fine particles are projected from the tabular alumina hydrate with a convex shape, so that scuffing resistance can be improved while maintaining glossiness.

As the alumina of the present invention, γ-alumina which is γ type crystal of aluminum oxide is preferred, and of these, δ group crystal is preferred. In γ-alumina, its primary particle can be made as small as about 10 nm, and in general, those in which secondary particle crystals having several thousands to several ten thousands nm are pulverized by ultrasonic wave, a high-pressure homogenizer, a counter collision type jet pulverizer or the like to about 50 to 300 nm are preferably used.

The alumina hydrate of the present invention is represented by the formula: $Al_2O_3.nH_2O$ (n=1 to 3). When n is 1, it shows alumina hydrate having a boehmite structure, and when n is greater than 1 and less than 3, it shows a pseudo boehmite structure alumina hydrate. It can be obtained by conventionally known production methods such as hydrolysis of aluminum alkoxide such as aluminum isopropoxide, etc., neutralization of an aluminum salt by an alkali, hydrolysis of an aluminate, etc.

An average particle size of the primary particle of the fumed silica, alumina and alumina hydrate of the present invention can be measured by an observation using an electron microscope where the particles are dispersed sufficiently enough for the primary particle being identified, and for each of 100 particles existing in a predetermined area, a diameter of a circle whose area is equivalent to a projected area of each particle is taken as a particle diameter for that particle. An average particle size of the primary particles of the fumed silica to be used in the present invention is preferably 5 to 50 nm, more preferably 5 to 30 nm. An average particle size of the primary particles of the alumina and alumina hydrate to be used in the present invention is preferably 10 to 50 nm, more preferably 10 to 30 nm.

Incidentally, the average particle size of the secondary particle of the fumed silica, alumina and alumina hydrate according to the present invention can be measured by measuring a diluted dispersion with a laser diffraction/scattered type grain distribution measurement device.

The above-mentioned alumina and alumina hydrate to be used in the present invention can be used in a form of a dispersion in which they are dispersed by a conventionally known dispersant such as lactic acid, formic acid, nitric acid, etc.

In the present invention, a range of the average particle size of the secondary particles of the alumina or alumina hydrate to be used in the ink-receptive layer B is preferably 140 to 250 nm, more preferably 150 to 200 nm. If it is smaller than 140 nm, ink-absorption property tends to be lowered, while if it is greater than 250 nm, surface glossiness tends to be lowered.

In the present invention, a range of the total amount of the fumed silica to be used in the ink-receptive layer A is preferably 8 to 30 g/m$^2$, more preferably 10 to 28 g/m$^2$. The above-mentioned range is preferred in the points of ink-absorption property and strength of the ink-receptive layer.

In the present invention, a range of the total amount of the alumina or alumina hydrate to be used in the ink-receptive layer B is 0.5 to 18 g/m$^2$, preferably 1 to 14 g/m$^2$. The above-mentioned range is preferred in the points of glossiness and ink-absorption property.

In the present invention, the sum of the weight of the fumed silica in the ink-receptive layer A and that of the alumina or alumina hydrate in the ink-receptive layer B is 12 to 35 g/m$^2$, preferably 15 to 30 g/m$^2$. By making the sum in that range, sufficient ink-absorption property can be obtained, and it is preferred in the point of strength of the ink-receptive layer.

In the present invention, by using the fumed silica in the ink-receptive layer A which is a lower layer and near to the support, and by using the alumina or alumina hydrate in the ink-receptive layer B which is an upper layer, good printed image having good glossiness and ink printed at the surface layer being rapidly absorbed in the lower layer without causing bleeding or beading can be obtained. In particular, even when pigment ink is used, ink-absorption property is good, and high printing density and coloring property can be obtained.

If an average particle size of the primary particle of the fumed silica in the lower layer is greater than 50 nm, glossiness tends to be lowered, and ink absorption of the lower layer is too fast, so that a coloring agent or an adhesive in the ink is difficultly fixed in the upper layer, whereby the printed portion tends to be damaged, glossiness at the printed portion tends to be lowered and the color becomes darkish with a low printing density. To the contrary, when the average particle size of the primary particle of the fumed silica in the lower layer is too small, ink tends to be maintained in the upper layer, so that bleeding or beading is likely caused. Accordingly, a preferred average primary particle size of the fumed silica is 5 to 50 nm, more preferably 5 to 30 nm.

Moreover, by using the alumina or alumina hydrate which tends to be positively charged is used in the ink-receptive layer B as the upper layer, fixing property of the acidic dye, the direct dye or the pigment in ink becomes good, wherein high printing density or coloring property can be obtained. If the average particle size of the primary particle of the alumina or alumina hydrate in the upper layer is greater than 50 nm, glossiness at the surface is lowered, and transparency of the ink-receptive layer is inferior, and due to sinkage of the coloring agent, printing density is difficultly obtained. When it is too small to the contrary, ink-absorption property tends to be lowered and in particular, and it becomes a problem in the pigment ink. Accordingly, a preferred average primary particle size of the alumina or alumina hydrate is 8 to 50 nm, more preferably 10 to 30 nm. A ratio of the average primary particle size of the alumina or alumina hydrate to the fumed silica is preferably 1/1 to 5/1. According to this constitution, glossiness and ink-absorption property are excellent. In particular, when pigment ink is used, fixing property of ink is improved and a printed image becomes good.

The reason is uncertain why glossiness and ink-absorption property are good in the combination of the upper layer and the lower layer of the present invention, but it can be estimated as follows. That is, when the ink-receptive layer is a single layer and uses therein relatively fine alumina or alumina hydrate, glossiness is good but the obtained voids are fine so that ink-absorption property tends to be lowered. In the present invention, by using alumina and alumina hydrate in the upper layer, glossiness is good, and their shape is substantially a fibrous state or close to a tabular shape, while the shape of the fumed silica used in the lower layer is close to sphere, so that there is a great difference between the shape of both materials. Moreover, ionic properties of the surfaces thereof are different from each other, and disorder between layers occur at the interface between the upper layer and the lower layer, so that capillaries of the upper and lower layers are easily connected continuously whereby it can be expected that permeation of ink from the upper layer to the lower layer is rapidly carried out by capillary force. In particular, when a ratio of the average primary particle size of the alumina or alumina hydrate relative to that of the fumed silica is 1/1 to 5/1, then, glossiness and ink-absorption property are further excellent.

To the ink-receptive layers A and B of the present invention, a hydrophilic binder is added to maintain the characteristics as a film. As the hydrophilic binder to be used, those conventionally known various kinds of binders can be used, and a hydrophilic binder which has high transparency and gives high permeability of ink is preferably used. For using the hydrophilic binder, it is important that the hydrophilic binder does not clog the voids by swelling at the initial stage of permeation of ink. From this point of view, a hydrophilic binder having a relatively low swellability at around the room temperature is preferably used. A particularly preferred hydrophilic binder is a completely or partially saponified polyvinyl alcohol or a cationic-modified polyvinyl alcohol.

Among the polyvinyl alcohols, particularly preferred is partially or completely saponified polyvinyl alcohol having a saponification degree of 80% or more. Polyvinyl alcohols having an average polymerization degree of 500 to 5000 are preferred.

Also, as the cationic-modified polyvinyl alcohol, there may be mentioned, for example, a polyvinyl alcohol having a primary to tertiary amino groups or a quaternary ammonium group at the main chain or side chain of the polyvinyl alcohol as disclosed in Japanese Provisional Patent Publication No. 10483/1986.

Also, other hydrophilic binder may be used in combination, but an amount thereof is preferably 20% by weight or less based on the amount of the polyvinyl alcohol.

In the ink-receptive layer A of the present invention, other inorganic fine particles than fumed silica may be contained in an amount of about 30% by weight or less of the amount of the fumed silica. Also, in the ink-receptive layer B, other inorganic fine particles may be contained in an amount of about 30% by weight or less of the amount of the alumina and alumina hydrate.

In the respective layers of the ink-receptive layers according to the present invention, a weight ratio of the inorganic fine particles (fumed silica, alumina or alumina hydrate) and the hydrophilic binder is preferably in the range of 60:40 to 92:8, more preferably 70:30 to 90:10. In particular, when a pigment ink is used, a ratio of the above inorganic fine particles is preferably 70% or more in view of an ink-absorption property.

In the present invention, it is preferred that the ink-receptive layer B contains fine particles having an average particle size of 3 to 10 $\mu$m. As the fine particles, inorganic or organic fine particles may be used, and preferably organic resin fine particles. Also, a ratio of an average particle size of the organic resin fine particles relative to the thickness of the ink-receptive layer B is preferably in the range of 2/3 to 3/1. By adding the above-mentioned fine particles to the ink-receptive layer B, uneven glossiness can be overcome when printing is carried out by using pigment ink. That is, difference in glossiness between an unprinted portion and a printed portion, or difference in glossiness between printed portions due to difference in printing density can be improved. Furthermore, there is an effect of improving scuffing resistance at the printed portion with pigment ink.

A content of the above-mentioned fine particles is 0.1 to 6 parts by weight, preferably 1 to 5 parts by weight based on 100 parts by weight of the alumina or alumina hydrate in the ink-receptive layer B. Incidentally, in the present invention, a thickness of the ink-receptive layer B and a thickness of the tabular alumina hydrate can be measured by sectional observation using an electron scanning microscope.

As the above-mentioned organic resin fine particles, there may be mentioned, for example, olefin homopolymer or copolymer such as polyethylene, polypropylene, polyisobutyrene, polyethylene oxide, polytetrafluoroethylene, polystyrene, ethylene-(meth)acrylic acid copolymer, ethylene-(meth)acrylate copolymer, ethylene-vinyl acetate copolymer and the like or a derivative thereof, polyvinyl chloride, vinyl chloride-vinyl acetate copolymer, vinyl chloride-(meth)acrylate copolymer, polyvinylidene chloride, styrene-butadiene rubber, NBR rubber and the like, singly or in admixture thereof. Incidentally, (meth)acrylic acid or (meth)acrylate herein means acrylic acid and/or methacrylic acid, or acrylate and/or methacrylate.

In the present invention, after coating the ink-receptive layer, it is preferred that the film surface temperature is made 20° C. or lower, preferably 15° C. or lower, since occurrence of a wave-like pattern made by the wind at the time of drying can be prevented, a manufacturing efficiency is improved and ink-absorption property becomes good.

The ink-jet recording material of the present invention preferably has a Haze value regulated by JIS-K-7105 of the laminated ink-receptive layers is preferably 40% or less, more preferably 30% or less. If it is higher than 40%, printing density is lowered and coloring property is also lowered.

The respective layers of the ink-receptive layers according to the present invention may preferably contain a cationic polymer for the purpose of improving water resistance or the like. As the cationic compounds, there may be mentioned a cationic polymer and a water-soluble metallic compounds. Also, when the cationic polymer is used in combination with the fumed silica, it tends to lower transparency, and the water-soluble metallic compound is contrary to the above to improve transparency. This is estimated that the water-soluble metallic compound inhibits fine cracks occurring at the ink-receptive layer comprising the fumed silica whereby transparency is improved.

As the cationic compound to be used in the present invention, there may be mentioned, for example, a cationic polymer and a water-soluble metallic compound. As the cationic polymer, there may be preferably mentioned polyethyleneimine, polydiallylamine, polyallylamine, polyalkylamine, as well as polymers having a primary to tertiary amino group or a quaternary ammonium salt group as disclosed in Japanese Provisional Patent Publications No. 20696/1984, No. 33176/1984, No. 33177/1984, No. 155088/1984, No. 11389/1985, No. 49990/1985, No. 83882/1985, No. 109894/1985, No. 198493/1987, No. 49478/1988, No. 115780/1988, No. 280681/1988, No. 40371/1989, No. 234268/1994, No. 125411/1995 and No. 193776/1998, etc. A molecular weight (a weight average molecular weight; Mw) of these cationic polymers is preferably about 5,000 to about 100,000.

An amount of these cationic polymers is preferably 1 to 10% by weight, more preferably, 2 to 7% by weight based on the amount of the above-mentioned inorganic fine particles.

As the water-soluble metallic compound to be used in the present invention, there may be mentioned, for example, a water-soluble polyvalent metallic salt. There may be mentioned a water-soluble salt of a metal selected from the group consisting of calcium, barium, manganese, copper, cobalt, nickel, aluminum, iron, zinc, zirconium, titanium, chromium, magnesium, tungsten, and molybdenum. More specifically, there may be mentioned, for example, calcium acetate, calcium chloride, calcium formate, calcium sulfate, barium acetate, barium sulfate, barium phosphate, manganese chloride, manganese acetate, manganese formate dihydrate, ammonium manganese sulfate hexahydrate, cupric chloride, copper (II) ammonium chloride dihydrate, copper sulfate, cobalt chloride, cobalt thiocyanate, cobalt sulfate, nickel sulfate hexahydrate, nickel chloride hexahydrate, nickel acetate tetrahydrate, ammonium nickel sulfate hexahydrate, amide nickel sulfate tetrahydrate, aluminum sulfate, aluminum sulfite, aluminum thiosulfate, poly(aluminum chloride), aluminum nitrate nonahydrate, aluminum chloride hexahydrate, ferrous bromide, ferrous chloride, ferric chloride, ferrous sulfate, ferric sulfate, zinc bromide, zinc chloride, zinc nitrate hexahydrate, zinc sulfate, titanium chloride, titanium sulfate, zirconium acetate, zirconium chloride, zirconium oxychloride octahydrate, zirconium hydroxychloride, zirconium nitrate, basic zirconium carbonate, zirconium hydroxide, zirconium lactate, ammonium zirconium carbonate, potassium zirconium carbonate, zirconium sulfate, zirconium fluoride, chromium acetate, chromium sulfate, magnesium sulfate, magnesium chloride hexahydrate, magnesium citrate nonahydrate, sodium phosphorus wolframate, tungsten sodium citrate, dodecawolframatophosphate n hydrate, dodecawolframatosilicate 26 hydrate, molybdenum chloride, dodecamolybdatephosphate n hydrate, etc. Of these, the zirconium type compounds having high transparency and water resistance improvement effects are preferably used.

Also, as the cationic compound, there may be mentioned a basic poly (aluminum hydroxide) compound which is an inorganic type aluminum-containing cationic polymer. The basic poly(aluminum hydroxide) means a water-soluble poly(aluminum hydroxide) a main component of which is represented by the following formula 1, 2 or 3, and which contains a polynuclear condensed ion which is basic and a polymer in a stable form, such as $[Al_6(OH)_{15}]^{3+}$, $[Al_8(OH)_{20}]^{4+}$, $[Al_{13}(OH)_{34}]^{5+}$, $[Al_{21}(OH)_{60}]^{3+}$, etc.

| | | |
|---|---|---|
| $[Al_2(OH)_n Cl_{6-n}]_m$ | | Formula 1 |
| $[Al(OH)_3]_n AlCl_3$ | | Formula 2 |
| $Al_n(OH)_m Cl_{(3n-m)}$ | $0 < m < 3n$ | Formula 3 |

These compounds are commercially available from Taki Chemical, K.K. under the trade name of poly(aluminum chloride) (PAC, trade name) as a water treatment agent, from Asada Chemical K.K. under the trade name of poly (aluminum hydroxide) (Paho, trade name), from K.K. Riken Green under the trade name of Pyurakemu WT (trade name) and other manufacturers with the same objects whereby various kinds of different grades can be easily obtained.

In the present invention, an amount of the above-mentioned water-soluble metallic compound in the ink-receptive layer is 0.1 g/m$^2$ to 10 g/m$^2$ preferably 0.2 g/m$^2$ to 5 g/m$^2$.

The above-mentioned cationic compound may be used in combination of two or more compounds. For example, the cationic polymer and the water-soluble metallic compound may be used in combination.

The respective layers of the ink-receptive layers of the present invention may preferably contain various kinds of oil droplets to improve brittleness of a film. As such oil droplets, there may be contained a hydrophobic high-boiling point organic solvent (for example, liquid paraffin, dioctyl phthalate, tricresyl phosphate, silicone oil, etc.) or polymer particles (for example, particles in which at least one of a polymerizable monomer such as styrene, butyl acrylate, divinyl benzene, butyl methacrylate, hydroxyethyl methacrylate, etc. is/are polymerized) each having a solubility in water at room temperature of 0.01% by weight or less. Such oil droplets can be used in an amount in the range of 10 to 50% by weight based on the amount of the hydrophilic binder.

In the present invention, it is preferred to use a cross-linking agent (hardening agent) of the hydrophilic binder in the respective layers of the ink-receptive layers. Specific examples of the hardening agent may include an aldehyde type compound such formaldehyde and glutaraldehyde, a ketone compound such as diacetyl and chloropentanedione, bis(2-chloroethylurea), 2-hydroxy-4,6-dichloro-1,3,5-triazine, a compound having a reactive halogen as disclosed in U.S. Pat. No. 3,288,775, divinylsulfone, a compound having a reactive olefin as disclosed in U.S. Pat. No. 3,635,718, a N-methylol compound as disclosed in U.S. Pat. No. 2,732,316, an isocyanate compound as disclosed in U.S. Pat. No. 3,103,437, an aziridine compound as disclosed in U.S. Pat. Nos. 3,017,280 and No. 2,983,611, a carbodiimide type compound as disclosed in U.S. Pat. No. 3,100,704, an epoxy compound as disclosed in U.S. Pat. No. 3,091,537, a halogen carboxyaldehyde compound such as mucochloric acid, a dioxane derivative such as dihydroxydioxane, an inorganic hardening agent such as chromium alum, zirconium sulfate, boric acid and a borate, and they may be used singly or in combination of two or more.

Among the hardening agents as mentioned above, boric acid and a borate are particularly preferred. As the boric acid to be used in the present invention, orthoboric acid, metaboric acid, hypoboric acid, and the like may be mentioned, and as the borate, a sodium salt, a potassium salt, an ammonium salt thereof may be mentioned. A content of the boric acid or borate is preferably 0.5 to 80% by weight in the ink-receptive layer A based on the amount of the polyvinyl alcohol, and preferably 0.5 to 50% by weight in the ink-receptive layer B based on the amount of the polyvinyl alcohol.

In the present invention, to the respective layers of the ink-receptive layers, various kinds of conventionally known additives such as a coloring dye, a coloring pigment, a fixing agent of an ink dye, an UV absorber, an antioxidant, a dispersant of the pigment, an antifoaming agent, a leveling agent, an antiseptic agent, a fluorescent brightener, a viscosity stabilizer, a pH buffer, etc. may be added in addition to the surfactant and the hardening agent.

In the present invention, a layer other than the ink-receptive layers A and B may be provided, and in that case, it is necessary that the layer does not impair the ink-absorption property. In the present invention, it is preferred to further provide a layer C containing colloidal silica on the ink-receptive layer B. The layer C containing colloidal silica has a role of a protective layer for the ink-receptive layer B. By providing the colloidal silica layer C on the surface of the ink-receptive layer B comprising the alumina or alumina hydrate which relatively causes scuffing, the surface of the ink-receptive layer B is protected, and as a result, occurrence of damage can be prevented.

Colloidal silica is a material in which silicon dioxide obtained by heating and maturing a silica sol which is obtained by metathesis of sodium silicate by an acid or passing through an ion exchange resin layer is dispersed in water in a colloidal state. The colloidal silica to be used in the present invention has an average primary particle size of about 5 to 100 nm. The colloidal silica is commercially available from Nissan Chemical Industries, Ltd. with various kinds of particle sizes and can be obtained. For example, there are ST-20L, ST-OL, ST-XL, ST-YL, ST-ZL, ST-OZL, and the like.

In the colloidal silica layer C, it is preferred that a colloidal silica (C-1) having an average primary particle diameter of less than 60 nm and a colloidal silica (C-2) having an average primary particle diameter of 60 nm or more are contained in combination. As the colloidal silica with less than 60 nm, that having 20 nm or more and less than 60 nm is preferred, in particular, that having 30 nm or more and less than 60 nm is preferred. As the colloidal silica with 60 nm or more, colloidal silica with 60 to 100 nm is preferred. According to such a constitution, the surface of the ink-receptive layer B can be protected while maintaining high ink-absorption property. The difference in an average primary particle diameter between the above-mentioned two kinds of the colloidal silica is preferably 10 nm or more, particularly preferably 20 to 60 nm.

There is a preferred range in a ratio of the contents of the above-mentioned two kinds of the colloidal silica. That is, colloidal silica (C-1):(C-2)=95:5 to 50:50. Total content of the colloidal silica in the colloidal silica layer C is preferably in the range of 0.3 to 5 g/m$^2$.

In the above-mentioned colloidal silica layer C, it is preferred to contain an organic binder in the range of 1 to 20% by weight based on the amount of the colloidal silica. As the organic binder, various kinds of hydrophilic binders or polymer latexes can be used. Preferred organic binder may include hydrophilic binders such as polyvinyl alcohol, carboxymethyl cellulose and polyvinylpyrrolidone. As the polymer latexes, there may be mentioned, for example, as the acrylic type latexes, an acrylate or methacrylate having an alkyl group, an aryl group, an aralkyl group, a hydroxyalkyl group, etc., a homopolymer or a copolymer of acrylonitrile, acrylamide, acrylic acid and methacrylic acid, or a copolymer of the above-mentioned monomers with styrenesulfonic acid, vinylsulfonic acid, itaconic acid, maleic acid, fumaric acid, maleic anhydride, vinyl isocyanate, allylisocyanate, vinyl methyl ether, vinyl acetate, styrene, divinylbenzene and the like. As the olefinic type latexes, a polymer comprising a copolymer of a vinyl monomer and a diolefin, and as the vinyl monomer, styrene, acrylonitrile, methacrylonitrile, methyl acrylate, methyl methacrylate, vinyl acetate, etc. are preferably used, and as the diolefins, butadiene, isoprene, chloroprene, etc.

In the colloidal silica layer C, by using a cross-linking agent (hardening agent) of the binder, prevention of surface defects occurring at the time of coating or drying, or scuffing resistance can be improved so that it is preferred. As the hardening agent, boric acid or a borate is particularly preferred. An amount of the hardening agent is preferably 0.1 to 40% by weight, more preferably 0.5 to 30% by weight. Also, to the colloidal silica layer C, a light resistance improving agent conventionally known in the art such as a UV absorber, hindered amines, hindered phenols, etc. may be added. In addition, it is also possible to add a surfactant, a thickening agent, a defoaming agent, a coloring agent, etc. may be possible to improve coating property.

In the present invention, the coating method of the respective layers constituting the ink-receptive layers is not particularly limited, and a coating method conventionally known in the art may be used. For example, there may be mentioned a slide bead system, a curtain system, an extrusion system, an air knife system, a roll coating system, a rod bar coating system, etc.

In the present invention, a system in which a plural number of layers can be coated simultaneously with multilayers such as a slide bead system is preferred. By subjecting at least two layers comprising the ink-receptive layers A and B to simultaneous multilayer coating, characteristics required for the respective layers can be obtained with good efficiency so that it is preferred. That is, this is estimated that by laminating the respective layers in a wet condition, components contained in the respective layers are difficultly permeated into the lower layer so that compositional constitution of the respective layer can be well maintained even after drying.

When a coating solution for the ink-receptive layer is coated onto a water resistance support such as a plastic resin film and a resin coated paper, prior to the coating, it is preferred to subject to a corona discharge treatment, a flame treatment, a UV ray irradiation treatment, a plasma treatment, and the like.

In the present invention, when a support, particularly a plastic resin film or a resin coated paper which is a water resistance support is used, it is preferred to provide a primer layer mainly comprising a natural polymer compound or a synthetic resin on the surface on which the ink-receptive layer is provided. After coating the ink-receptive layer of the present invention on said primer layer, the resulting material is cooled and dried at a relatively low temperature, whereby transparency of the ink-receptive layer is further improved.

The primer layer provided on the support mainly comprises natural polymer compound such as gelatin, casein, etc., or a synthetic resin. As such a synthetic resin, there may be mentioned an acrylic resin, a polyester resin, vinylidene chloride, a vinyl chloride resin, a vinyl acetate resin, polystyrene, a polyamide resin, a polyurethane resin, etc.

The above-mentioned primer layer is provided on the support with a thickness (dried thickness) of 0.01 to 5 $\mu$m. It is preferably in the range of 0.05 to 5 $\mu$m.

To the support according to the present invention, various kinds of back coating layer may be provided by coating for the purpose of a writing property, antistatic property, feeding and conveying property, curl preventing property, and the like, various kinds of back coating layer may be provided by coating. In the back coating layer, an inorganic antistatic agent, an organic antistatic agent, a hydrophilic binder, a latex, a pigment, a hardening agent, a surfactant and the like may be contained in optional combination.

EXAMPLE

In the following, the present invention will be explained in more detail by referring to Examples, but the content of the present invention is not limited by these Examples. Incidentally, part and % mean parts by weight and % by weight, respectively.

Example 1

<Preparation of a Polyolefin Resin-Coated Paper Support>

A mixture of a bleached kraft pulp of hardwood (LBKP) and a bleached sulfite pulp of hardwood (NBSP) with a weight ratio of 1:1 was subjected to beating until it becomes 300 ml by the Canadian Standard Freeness to prepare a pulp slurry. To the slurry were added alkyl ketene dimer in an amount of 0.5% by weight based on the amount of the pulp as a sizing agent, polyacrylamide in an amount of 1.0% by weight based on the same as a strengthening additive of paper, cationic starch in an amount of 2.0% by weight based on the same, and a polyamide epichlorohydrin resin in an amount of 0.5% by weight based on the same, and the mixture was diluted with water to prepare a 1%by weight slurry. This slurry was made paper by a tourdrinier paper machine to have a basis weight of 170 g/m$^2$, dried and subjected to moisture conditioning to prepare a base paper for a polyolefin resin-coated paper. A polyethylene resin composition comprising 100% by weight of a low density polyethylene having a density of 0.918 g/cm$^3$ and 10% by weight of anatase type titanium dispersed uniformly in the resin was melted at 320° C. and the melted resin composition was subjected to extrusion coating on the thus prepared base paper with a thickness of 35 $\mu$m by 200 m/min and subjected to extrusion coating by using a cooling roll subjected to slightly roughening treatment. On the other surface thereof, a blended resin composition comprising 70 parts by weight of a high density polyethylene resin having a density of 0.962 g/cm$^3$ and 30 parts by weight of a low density polyethylene resin having a density of 0.918 g/cm$^3$ was melted similarly at 320° C. and the melted resin composition was subjected to extrusion coating with a thickness of 30 $\mu$m and subjected to extrusion coating by using a cooling roller which had been subjected to roughening treatment.

Onto the surface of the above-mentioned polyolefin resin-coated paper was subjected to a high frequency corona discharge treatment, and then, a primer layer having the following composition was coated thereon to have a gelatin amount of 50 mg/m$^2$ and dried to prepare a support.

| <Primer layer> | |
|---|---|
| Lime-treated gelatin | 100 parts |
| Sulfosuccinic acid-2-ethylhexyl ester salt | 2 parts |
| Chromium alum | 10 parts |

Onto the above-mentioned support, coating solutions for ink-receptive layers A and B having the following two kinds of compositions were simultaneously coated by a slide bead coating device and dried. The coating solution for the ink-receptive layer A which is for a lower layer near to the support, and the coating solution for the ink-receptive layer B which is for an upper layer shown below were prepared after dispersing inorganic fine particles which became a solid content concentration of 9% by weight by a high-pressure homogenizer. These coating solutions were so coated that fumed silica in the ink-receptive layer A became a solid content of 16 g/m$^2$, and pseudo boehmite in the ink-receptive layer B became an amount of 6 g/m$^2$, and dried.

| <Coating solution for ink-receptive layer A> | |
|---|---|
| Fumed silica (average primary particle size 7 nm) | 100 parts |
| Dimethyldiallyl ammonium chloride homopolymer | 4 parts |
| Boric acid | 4 parts |
| Polyvinyl alcohol (saponification degree 88%, average polymerization degree 3500) | 20 parts |
| Surfactant | 0.3 part |
| Zirconium acetate | 2 parts |
| <Coating solution for ink-receptive layer B> | |
| Pseudo boehmite (tabular shape having an average primary particle size 15 nm, and an aspect ratio of 5) | 100 parts |
| Boric acid | 4 parts |
| Polyvinyl alcohol (saponification degree 88%, average polymerization degree 3500) | 20 parts |
| Surfactant | 0.3 part |
| Zirconium acetate | 2 parts |

Drying conditions after coating are shown below.

After cooling at 5° C. for 30 seconds, the coated material was dried at 45° C. and 10% RH (relative humidity) until the solid content concentration became 90% by weight, and then, at 35° C. and 10% RH.

With regard to the ink-jet recording sheet prepared as mentioned above, the following evaluations were carried out. The results are shown in Table 1.

<Ink-Absorption Property>

Each cyan, magenta and yellow single color 100% and triple colors 300% were subjected to printing by using a commercially available ink-jet printer (manufactured by ENCAD CO., NOVAJET) with GO ink, and immediately after the printing, a PPC paper was overlapped over the printed portion with a slight pressurization, and the degree of an amount of the ink transferred to the PPC paper was observed with naked eyes. They were evaluated totally with the following criteria. ○: No transfer was observed. Δ: Slightly transferred. X: Transfer remarkably occurred and practical use is impossible.

<Printing Density>

Printing density at a black solid portion was measured by a Macbeth reflection densitometer and an average value of 5 times measurements was shown.

<Glossiness>

Glossiness of a recording material before printing was observed by inclined light and evaluated by the following criteria. ○: There is high glossiness relative to a color photograph. Δ: There is glossiness relative to an art paper or a coat paper. X: There is dull glossiness like a pure paper.

Examples 2 to 4

In the same manner as in Example 1 except for changing weights of a solid component of fumed silica in the ink-receptive layer A and pseudo boehmite in the ink-receptive layer B of Example 1 to those shown in Table 1, ink-jet recording materials of Examples 2 to 4 were obtained. The evaluated results are shown in Table 1.

Example 5

In the same manner as in Example 1 except for changing the fumed silica in the ink-receptive layer A used in Example 1 to those having an average particle size of a primary particle of 30 nm, an ink-jet recording material of Example 5 was obtained. The evaluated results are shown in Table 1.

Example 6

In the same manner as in Example 1 except for changing the pseudo boehmite in the ink-receptive layer B used in Example 1 to γ-alumina (available from Nippon Aerosil K.K., Aerosil aluminum oxide C) having an average primary particle size of 13 nm, an ink-jet recording material of Example 6 was obtained. The evaluated results are shown in Table 1.

Example 7

In the same manner as in Example 1 except for changing the pseudo boehmite in the ink-receptive layer B used in Example 1 having an average primary particle size of 15 nm to those having that of 40 nm, an ink-jet recording material of Example 7 was obtained. The evaluated results are shown in Table 1.

Comparative Example 1

In the same manner as in Example 1 except that it is made a single layer of the ink-receptive layer A alone of Example 1 and a coated amount of the fumed silica was changed to 22 g/m$^2$, an ink-jet recording material of Comparative example 1 was obtained. The results are shown in Table 1.

Comparative Example 2

In the same manner as in Example 1 except that it is made a single layer of the ink-receptive layer B alone of Example 1 and a coated amount of the pseudo boehmite was changed to 22 g/m$^2$, an ink-jet recording material of Comparative example 2 was obtained. The evaluated results are shown in Table 1.

Comparative Example 3

In the same manner as in Example 1 except for changing the fumed silica used in the ink-receptive layer A of Example 1 to a wet system synthetic silica (available from Nippon Silica Industrial Co., Nipsil E-1011, average particle size of 2 μm), an ink-jet recording material of Comparative example 3 was obtained. The results are shown in Table 1.

Comparative Example 4

In the same manner as in Example 1 except for coating a coating solution in which the coating solution for the ink-receptive layer A and the coating solution for the ink-receptive layer B were mixed with a ratio of 16:6 as a single layer to make coated amounts of the fumed silica being 16 g/m$^2$ and the pseudo boehmite being 6 g/m$^2$, an ink-jet recording material of Comparative example 4 was obtained. The results are shown in Table 1.

Comparative Example 5

In the same manner as in Example 1 except for using the coating solution for an ink-receptive layer B which is for an upper layer using pseudo boehmite as the ink-receptive layer A at the lower layer and using the coating solution for an ink-receptive layer A which is for a lower layer using fumed silica as the ink-receptive layer B for an upper layer in Example 1, an ink-jet recording material of Comparative example 5 was obtained. The results are shown in Table 1.

TABLE 1

| | Weight of inorganic fine particles Lower layer\ Upper layer | Ink-absorption property | Printing density | Glossiness |
|---|---|---|---|---|
| Example 1 | 16\6 | ○ | 2.22 | ○ |
| Example 2 | 10\6 | Δ | 2.23 | ○ |
| Example 3 | 7\15 | Δ | 2.25 | ○ |
| Example 4 | 21.5\0.5 | ○ | 2.08 | Δ |
| Example 5 | 16\6 | ○ | 2.07 | Δ |
| Example 6 | 16\6 | ○ | 2.10 | ○ |
| Example 7 | 16\6 | ○ | 2.12 | Δ |
| Comparative example 1 | 0\22 | ○ | 1.85 | Δ |
| Comparative example 2 | 0\22 | X | 2.20 | ○ |
| Comparative example 3 | 16\6 | Δ | 1.75 | X |
| Comparative example 4 | 0\22 | Δ | 1.90 | Δ |
| Comparative example 5 | 16\6 | X | 1.83 | Δ |

Note:
A unit for weight of inorganic fine particles is $g/m^2$, and the lower layer means an ink-receptive layer A, and the upper layer means an ink-receptive layer B.

Results; Examples 1 to 3 are the cases wherein coated amounts of the fumed silica in the ink-absorption layer A and the pseudo boehmite in the ink-absorption layer B are changed. Example 2 in which an amount of the fumed silica had been reduced to 10 $g/m^2$ was lowered in ink-absorption property than that of Example 1, but it could be practically used. In Example 3 in which coated amounts of the fumed silica and the pseudo boehmite had been made 7 $g/m^2$ and 15 $g/m^2$, respectively, ink-absorption property was slightly lowered but it could be practically used, and glossiness was superior to that of Example 1. In Example 4 in which the coated amounts of the fumed silica and the pseudo boehmite had been made 21.5 $g/m^2$ and 0.5 $g/m^2$, respectively, in Example 1, ink-absorption property was extremely good, and glossiness and printing density were slightly lowered but it satisfied a level of practical use. In Example 5 in which coarse fumed silica having an average primary particle size of 30 nm was used in the ink-absorption layer A of Example 1, printing density and glossiness were slightly lowered than those of Example 1 but it could be practically used. Example 6 in which the pseudo boehmite in the ink-receptive layer B of Example 1 had been changed to γ-alumina was slightly lowered in printing density but totally good. Example 7 is the case wherein an average primary particle size of the pseudo boehmite in the ink-receptive layer B of Example 1 had been changed to 40 nm, and glossiness was slightly lowered by it could be practically used.

In Comparative example 1 in which a single layer of the ink-receptive layer A alone had been employed and 22 $g/m^2$ of the fumed silica was coated in Example 1, glossiness was lowered and printing density was markedly lowered. In Comparative example 2 in which a single layer of the ink-receptive layer B alone had been employed and 22 $g/m^2$ of the pseudo boehmite was coated in Example 1, ink-absorption property was markedly lowered and it could not be practically used. In Comparative example 3 in which a wet type synthetic silica having an average particle size of 2.5 μm had been used in place of the fumed silica used in the ink-receptive layer A of Example 1, ink-absorption property was lowered, and printing density and glossiness were markedly lowered, so that it could not be practically used. In Comparative example 4 in which the coating solutions for the ink-receptive layers A and B of Example 1 had been mixed and coated as a single layer, ink-absorption property and glossiness were lowered, and printing density was markedly lowered, so that it was not a level of practical use. In Comparative example 5 in which the coating solutions for the upper layer and the lower layer had been exchanged in Example 1 and fumed silica had been used in the upper layer, glossiness was lowered, and ink-absorption property and printing density were markedly lowered, so that it could not be practically used.

Example 8

In the same manner as in Example 1 except for changing the coating solution for the ink-receptive layer B of Example 1 was changed to a composition as mentioned below, a recording material was prepared. An average thickness of a sectional surface of the ink-receptive layer B according to an electron microscopic observation was 7 μm.

| <Coating solution for ink-receptive layer B> | |
|---|---|
| Pseudo boehmite (tabular shape having an average primary particle size 13 nm, and an aspect ratio of 3) | 100 parts |
| Acetic acid | 1 part |
| Spherical fine particles (polyethylene spherical particle having an average particle size of 0.25 μm) | 3 parts |
| Boric acid | 4 parts |
| Polyvinyl alcohol (saponification degree 88%, average polymerization degree 3500) | 20 parts |
| Surfactant | 0.3 part |
| Zirconium acetate | 2 parts |

In the above-mentioned ink-receptive layer B, Sample (8-1) containing spherical fine particles and Sample (8-2) containing no spherical fine particles were prepared.

With regard to the ink-jet recording sheets prepared as mentioned above, evaluation was carried out in the same manner as in Example 1 except for the following scuffing resistance.

<Scuffing Resistance>

Two sheets of recording materials before printing were overlapped with the front surfaces being upper sides, by placing a 50 g weight having a circular bottom surface with a diameter of 2 cm thereon, and after slowly pulling the upper recording material, damages on the surface of the under recording material were observed.

As a result of the tests, with regard to scuffing resistance, Sample (8-1) is superior to Sample (8-2). Ink-absorption property and glossiness were ○ in both cases. Printing density was 2.16 in Sample (8-1) and 2.22 in Sample (8-2), and the both showed high levels.

Example 9

A support on which a primer layer had been coated was used as in Example 1, and the coating solutions for ink-receptive layers A and B mentioned below were simultaneously coated on the support by a slide bead coating device, and dried. A coating solution for the ink-receptive layer A which is for a lower layer and a coating solution for the ink-receptive layer B which is for an upper layer were each prepared so that each becomes a solid content concentration of 10% by weight. These coating solutions were so coated that fumed silica in the ink-receptive layer A became a solid content of 18 g/m$^2$, and pseudo boehmite in the ink-receptive layer B became an amount of 6 g/m$^2$, and dried. A thickness of the receptive layer B was 5.5 $\mu$m. The drying conditions were the same as in Example 1.

| <Coating solution for ink-receptive layer A> | |
|---|---|
| Fumed silica (average primary particle size 20 nm) | 100 parts |
| Dimethyldiallyl ammonium chloride homopolymer | 4 parts |
| Boric acid | 4 parts |
| Polyvinyl alcohol (saponification degree 88%, average polymerization degree 3500) | 20 parts |
| Surfactant | 0.3 part |
| <Coating solution for ink-receptive layer B> | |
| Pseudo boehmite (average primary particle size 14 nm , average secondary particle size 160 nm) | 100 parts |
| Organic resin fine particles (ethylene-vinyl acetate copolymer; Chemipearl V-200 available from Mitsui Chemical Co., Ltd., average particle size of 7 $\mu$m) | 4 parts |
| Boric acid | 0.5 part |
| Polyvinyl alcohol (saponification degree 88%, average polymerization degree 3500) | 10 parts |
| Surfactant | 0.3 part |

In the above-mentioned ink-receptive layer B, Sample (9-1) containing organic resin fine particles and Sample (9-2) containing no organic resin fine particles were prepared.

With regard to two kinds of the ink-jet recording sheets prepared as mentioned above, difference in glossiness at printed portions, ink-absorption property, printing density, and scuffing resistance were evaluated according to the following test methods.

<Difference in Glossiness at Printed Portions>

Cyan, magenta and yellow were each subjected to solid printing with a setting of 100% and 50%, respectively, by using a commercially available ink-jet printer (available from Seiko Epson Corporation, MC-2000) for pigment ink, and difference in glossiness at the 50% solid printing portion and 100% solid printing portion was judged with eyes.

<Ink-Absorption Property>

Multicolor pattern of red, green, blue and black was printed by using a commercially available ink-jet printer (available from Seiko Epson Corporation, MC-7000) for pigment ink, and absorbed state of the ink immediately after printing was observed with eyes.

<Printing Density>

A 100% black solid portion was printed by using a commercially available ink-jet printer (available from Seiko Epson Corporation, MC-2000) for pigment ink, and measurement was carried out by a Macbeth reflection densitometer and an average value of 5 times measurements was shown.

<Scuffing Resistance>

A 60% black solid portion was printed by commercially available ink-jet printer (available from Seiko Epson Corporation, MC-2000) for pigment ink, and after drying it under the conditions of 23° C. and 50% RH overnight, the printed surface was contacted to the polyolefin resin-coated paper support prepared by fixing to a flat bed, and under a load of 20 g/cm$^2$, the printed material was slid horizontally and a degree of occurrence of damage at the printed surface was observed with eyes.

As a result of the test, with regard to the difference in glossiness at the printed portion and scuffing resistance, Sample (9-1) is superior to Sample (9-2). With regard to ink-absorption property, both were good without overflowing the pigment ink. With regard to printing density, both were good as 2.2.

Example 10

In the same manner as in Example 1, a support, an ink-receptive layer A and an ink-receptive layer B were prepared. Moreover, a colloidal silica layer C shown below was prepared. On the support, the ink-receptive layer A, the ink-receptive layer B and the colloidal silica layer C were simultaneously coated by a slide bead coater. A coated amount of fumed silica of the ink-receptive layer A was 16 g/m$^2$, a coated amount of pseudo boehmite of the ink-receptive layer B was 6 g/m$^2$, and a coated amount of colloidal silica of the colloidal silica layer was 3 g/m$^2$. The drying conditions after the coating were the same as in Example 1.

| <Coating solution for colloidal silica layer C> | |
|---|---|
| Colloidal silica | 100 parts |
| Polyvinyl alcohol (saponification degree 88%, average polymerization degree 3500) | 5 parts |
| Boric acid | 2 parts |
| Surfactant | 0.3 part |

In the above-mentioned colloidal silica layer C, Sample (10-1) in which colloidal silica (available from Nissan Chemical Industries, Ltd., SNOWTEX OL-40) having an average primary particle size of 45 nm was used, and Sample (10-2) in which 60 parts of colloidal silica having an average primary particle diameter of 45 nm and 40 parts of colloidal silica (available from Nissan Chemical Industries, Ltd., SNOWTEX OZL) having an average primary particle diameter of 80 nm were used in combination were prepared. Moreover, Sample (10-3) providing no colloidal silica layer was prepared.

With regard to the ink-jet recording sheets prepared as mentioned above, scuffing resistance, glossiness, ink-absorption property and printing density were evaluated according to the following methods.

<Scuffing Resistance>

Two sheets of ink-jet recording materials not yet subjected to printing were overlapped with the front surfaces being upper sides, and after pulling out the lower side recording material while placing a 100 g weight thereon, damages on the surface of the ink-receptive layer were observed.

<Glossiness>

Glossiness of a recording material before printing was observed by inclined light.

<Ink-Absorption Property>

Black solid printing was carried out by using an ink-jet printer MJ-5100C (aqueous dye ink was used) available from Seiko Epson Corporation, immediately after the printing, a PPC paper was overlapped over the printed portion with a slight pressurization, and the degree of an amount of the ink transferred to the PPC paper was observed with naked eyes.

<Printing Density>

Printing density at the black solid portion was measured by a Macbeth reflection densitometer.

As a result of the test, with regard to scuffing resistance, Samples (10-1) and (10-2) are superior to that of (10-3). With regard to ink-absorption property, Samples (10-2) and (10-3) are excellent and Sample (10-1) is slightly inferior to these but it is still a high level. With regard to glossiness and printing density, these three samples are the same level.

UTILIZABILITY IN INDUSTRY

As can be clearly seen from the above results, the ink-jet recording materials of the present invention are excellent in ink-absorption property, glossiness and scuffing resistance. Moreover, the ink-jet recording materials of the present invention have high ink-absorption property, high printing density without uneven glossiness even when printing is carried out by pigment ink.

What is claimed is:

1. An ink-jet recording material which comprises a support and at least two ink-receptive layers containing inorganic fine particles and a hydrophilic binder provided by coating thereon, wherein an ink-receptive layer (A) nearer to the support contains fumed silica, and an ink-receptive layer (B) apart from the support contains γ-alumina as alumina or pseudo boehmite as alumina hydrate.

2. The ink-jet recording material according to claim 1, wherein a ratio of the average primary particle diameter of the alumina or alumina hydrate relative to the average primary particle diameter of the fumed silica is 1/1 to 5/1.

3. The ink-jet recording material according to claim 1, wherein the ink-receptive layer A is provided by coating 10 to 28 $g/m^2$ of the fumed silica, the ink-receptive layer B is provided by coating 1 to 14 $g/m^2$ of the alumina or alumina hydrate, and the sum of the fumed silica, alumina and alumina hydrate is provided by coating in an amount of 15 to 30 $g/m^2$.

4. The ink-jet recording material according to claim 1, wherein a primary particle of the alumina hydrate has a tabular shape.

5. The ink-jet recording material according to claim 4, wherein the primary particle of the alumina hydrate has a tabular shape having an aspect ratio of 2 or more.

6. The ink-jet recording material according to claim 1, wherein the ink-receptive layer B contains a tabular alumina hydrate having an aspect ratio of 2 or more, and contains spindle shaped or spherical shaped fine particles having an average particle size of 3 μm or less.

7. The ink-jet recording material according to claim 6, wherein the ink-receptive layer B has an average thickness of 1 μm or more, and an average particle size of the spindle shaped or spherical shaped fine particles is 1 μm or less.

8. The ink-jet recording material according to claim 6, wherein a ratio of the average particle size of the spindle shaped or spherical shaped fine particles relative to the average thickness of the primary particle of the tabular alumina hydrate is 2/1 to 80/1.

9. The ink-jet recording material according to claim 1, wherein a layer (C) containing colloidal silica is further provided on the ink-receptive layer B.

10. The ink-jet recording material according to claim 9, wherein the layer (C) containing the colloidal silica contains colloidal silica having an average primary particle diameter of less than 60 nm and colloidal silica having an average primary particle diameter of 60 nm or more in combination.

11. The ink-jet recording material according to claim 1, wherein the ink-receptive layer B contains fine particles having an average particle size of 3 to 10 μm.

12. The ink-jet recording material according to claim 11, wherein the fine particles contained in the ink-receptive layer (B) are organic resin fine particles having an average particle size of 3 to 10 μm.

13. The ink-jet recording material according to claim 11, wherein a ratio of the average particle size of the fine particles relative to the thickness of the ink-receptive layer B is 2/3 to 3/1.

14. The ink-jet recording material according to claim 1, wherein the support is a water resistance support.

15. The ink-jet recording material according to claim 1, wherein the above at least two layers of the ink-receptive layer are simultaneously provided by coating.

16. An ink-jet recording material which comprises a support and at least two ink-receptive layers containing inorganic fine particles and a hydrophilic binder provided by coating thereon, wherein an ink-receptive layer (A) nearer to the support contains fumed silica, and an ink-receptive layer (B) apart from the support contains alumina hydrate in which a primary particle thereof is a tabular shape.

17. The ink-jet recording material according to claim 1, wherein the fumed silica has a secondary particle size of about 50 to 300 nm.

* * * * *